US011661937B2

(12) United States Patent
Becher

(10) Patent No.: US 11,661,937 B2
(45) Date of Patent: May 30, 2023

(54) METHOD AND DEVICE FOR DETERMINING A WEAR CONDITION IN A HYDROSTATIC PUMP

(71) Applicant: MOOG GmbH, Boeblingen (DE)

(72) Inventor: Dirk Becher, Nufringen (DE)

(73) Assignee: Moog GmbH, Boeblingen (DE)

( * ) Notice: Subject to any disclaimer, the term of this patent is extended or adjusted under 35 U.S.C. 154(b) by 23 days.

(21) Appl. No.: 16/762,716

(22) PCT Filed: Nov. 8, 2018

(86) PCT No.: PCT/EP2018/080647
§ 371 (c)(1),
(2) Date: May 8, 2020

(87) PCT Pub. No.: WO2019/092122
PCT Pub. Date: May 16, 2019

(65) Prior Publication Data

US 2021/0172433 A1 Jun. 10, 2021

(30) Foreign Application Priority Data

Nov. 10, 2017 (DE) ..... 102017126341.1

(51) Int. Cl.
*F04B 49/06* (2006.01)
*F04B 19/22* (2006.01)
(Continued)

(52) U.S. Cl.
CPC ..... *F04B 49/065* (2013.01); *F04B 1/04* (2013.01); *F04B 19/22* (2013.01); *F04B 49/103* (2013.01);
(Continued)

(58) Field of Classification Search
CPC ..... F04B 1/04; F04B 19/22; F04B 49/065; F04B 49/103; F04B 49/106; F04B 51/00;
(Continued)

(56) References Cited

U.S. PATENT DOCUMENTS 5,563,351 A 10/1996 Miller
5,846,056 A * 12/1998 Dhindsa ..... F04B 23/06 417/44.2
(Continued)

FOREIGN PATENT DOCUMENTS

CN 204371569 U 6/2015
DE 102004028643 B3 9/2005
(Continued)

OTHER PUBLICATIONS

European Patent Office (ISA/EP), International Search Report and Written Opinion of the ISA in International Patent Application No. PCT/EP2018,080647, dated May 16, 2019.
(Continued)

*Primary Examiner* — Alexander B Comley
(74) *Attorney, Agent, or Firm* — Harter Secrest & Emery LLP

(57) ABSTRACT

A method for determining a current wear (w) of a hydrostatic pump, particularly of a radial piston pump, with a variable-speed drive, where the pump is connected to a fluid passage, in which a fluid is pumped by the pump to create a current actual volume flow in the fluid passage. A current actual volume flow ($Q_{act}$) is determined, by measuring the volume flow in the fluid passage at a predetermined drive-vector, a computed volume flow ($Q_{comp}$) is determined, by a first computational method, at the predetermined drive-vector, and the current wear (w) of the pump is determined, by a
(Continued)

Figure 1:
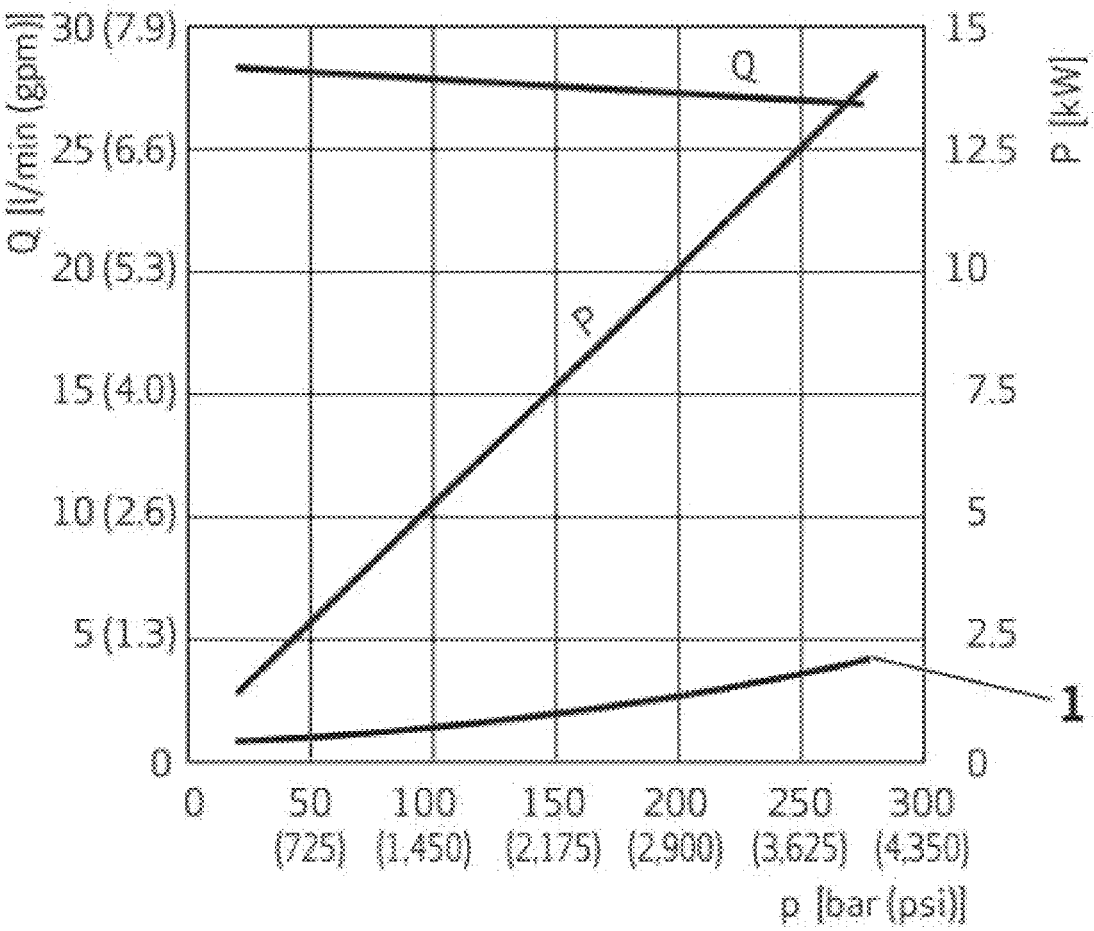

second computational method, which relates the current actual volume flow ($Q_{act}$) to the computed volume flow ($Q_{comp}$).

16 Claims, 4 Drawing Sheets

(51) Int. Cl.
*F04B 49/10* (2006.01)
*F04B 1/04* (2020.01)
*F04B 51/00* (2006.01)

(52) U.S. Cl.
CPC ..... *F04B 49/106* (2013.01); *F04B 51/00* (2013.01); *F04B 2201/0205* (2013.01); *F04B 2203/0209* (2013.01); *F04B 2205/09* (2013.01); *F04B 2205/14* (2013.01); *F04B 2205/18* (2013.01)

(58) Field of Classification Search
CPC ..... F04B 2201/0205; F04B 2201/0603; F04B 2203/0209; F04B 2205/09; F04B 2205/14; F04B 2205/18
See application file for complete search history.

(56) References Cited

U.S. PATENT DOCUMENTS 6,260,004 B1 7/2001 Hays et al.
6,648,606 B2 11/2003 Sabini et al.
6,882,960 B2 * 4/2005 Miller ..... F04B 51/00 702/177
7,043,975 B2 * 5/2006 Du ..... F15B 19/005 73/168
7,556,023 B2 * 7/2009 Ilhoshi ..... F02D 41/3836 123/480
8,751,170 B2 6/2014 Blumenthal et al.
9,140,255 B2 9/2015 Wetherill et al.
9,506,417 B2 * 11/2016 Ulrey ..... F02D 41/3845
10,458,416 B2 * 10/2019 Mangutov ..... F04D 15/0281
10,480,296 B2 * 11/2019 Beisel ..... F04B 47/02
2001/0052338 A1 12/2001 Yates
2002/0139350 A1 * 10/2002 Barnes ..... F02D 41/3845 123/456
2008/0302174 A1 12/2008 Puckett et al.
2011/0162447 A1 7/2011 Kirk et al.
2012/0247200 A1 * 10/2012 Ahonen ..... F04D 15/0272 73/168
2012/0251340 A1 10/2012 Ahonen et al.
2014/0255215 A1 * 9/2014 Yin ..... F04B 49/106 417/53
2015/0300287 A1 10/2015 Ulrey et al.
2016/0139097 A1 5/2016 Skarping et al.
2017/0138335 A1 * 5/2017 Becher ..... F03C 1/053
2017/0292513 A1 * 10/2017 Haddad ..... E21B 47/00
2018/0128705 A1 5/2018 Wetherill et al.
2018/0202423 A1 * 7/2018 Zhang ..... F04B 53/14

FOREIGN PATENT DOCUMENTS

DE 10157143 B4 1/2007
JP H08291788 A 11/1996
WO WO-2018160174 A1 * 9/2018 ..... F04B 49/06

OTHER PUBLICATIONS

Wu Lan . Zhao Ying, Applications of Turbo Pascal in Chemistry and Chemical Engineering, Mar. 31. 2004, pp. 303-308, ISBN 7-105-06110-3.

* cited by examiner

METHOD AND DEVICE FOR DETERMINING A WEAR CONDITION IN A HYDROSTATIC PUMP

The present invention relates to hydrostatic pumps, particularly to radial piston pumps, for creating a volume flow of a fluid. In many embodiments, said fluid is a hydraulic fluid.

Hydrostatic pumps are known in the art. These pumps comprise moving parts, which move or are moved, during their regular operation, along the surfaces of other parts of the pump. The friction, which occurs during these movements, leads to a wear-out of the pump, at least on the long run. This wear-out increases the leakage rate of the pump. This causes a reduction of the performance of the pump, i.e. a reduction of its volume flow and thus of the velocity of working equipment that is driven by means of the hydraulic fluid, e.g. of hydraulic cylinders, which are driven by the hydrostatic pump.

Hydrostatic pumps according to the state of the art have the drawback that their current wear-out is not known in every phase of its life-cycle. Hence, the current actual performance of the pump is not known, at least not known exactly. This, for instance, leads to an unknown performance of the overall system, which may lead to an unrecognized malfunction of the equipment driven by this pump, particularly in highly precise hydraulic systems. Consequently, it would be advantageous for an operator of a hydraulic system to run the driving pump in a well-defined mode, i.e. to know its current performance and to have a measure for its current wear-out. This should be related to its system variables, i.e. (for instance) to a pre-defined rotational speed, a pre-defined pressure, a pre-defined viscosity of the fluid, etc. Furthermore, it would be advantageous for the operator to know the current wear situation of the pump, because then—based on a quantitative value for the current wear situation of the pump—a wear-optimised maintenance could be initiated.

Therefore, it is task of this invention to overcome the disadvantages of the state of the art, at least partly.

This task is solved by a method according to claim 1 and an apparatus according to claim 14. Preferred embodiments are subject of dependent claims.

The invention comprises a method for determining a current wear of a hydrostatic pump, particularly of a radial piston pump, with a variable-speed drive, where the pump is connected to a fluid passage, in which a fluid is pumped by the pump, the pump creating a current actual volume flow in the fluid passage. The method is characterized in that a current actual volume flow is determined, by means of measuring the volume flow in the fluid passage at a predetermined drive-vector, a computed volume flow is determined, by means of a first computational method, at the predetermined drive-vector, and the current wear of the pump is determined, by means of a second computational method, which relates the current actual volume flow to the computed volume flow.

Using this method, an actual volume flow of the hydrostatic pump needs to be measured. This is done in the fluid passage where the pump is connected to. Although it is known that a wear-out of a pump leads to a reduced actual volume flow, it is not possible, using state of the art methods, to infer from a measured volume flow to the current wear-out of this pump. The reason is that the actual volume flow—which can be measured—depends on a lot of system variables, e.g. on the viscosity and/or the temperature and/or the pressure of the hydraulic fluid. Moreover, at least some of these system variables depend on other system variables, sometimes in a complex way. One example could be that the viscosity of the hydraulic fluid may depend on its temperature, and this dependency may depend on the type of fluid used and could be different for every type of pump, e.g. depending on the pump's maximal performance. As one further example, there could also be a dynamic dependency between system variables, e.g. in a transition situation the dependency between the rotational speed of the pump and the fluid's pressure is best described by a differential equation.

The system variables that influence the volume flow of a pump can be represented by a drive-vector of dimension D. Each dimension of the drive-vector has a relevant range, i.e. a minimum and a maximum value, which are either the ranges of physically allowed values—possibly limited by technical constraints—or otherwise limited. For instance, the range of a fluid's pressure p in one certain type of pump could be: range (p)=($p_{min}$, $p_{max}$)=(10 bar, 300 bar).

Based on the knowledge of the behaviour of a certain pump—or of a class of pumps—a mathematical model of this pump can be made, depending on the values of the drive-vector. This model serves as a basis for the first computational method. Basically, the pump's volume flow may be computed by a function that takes all relevant values of each dimension of the drive-vector into account.

One simple exemplary implementation of the first computational method may—for the sake of a simplified example—only consider a drive-vector consisting of rotational speed n and a pressure p. This first computational method, for instance, could compute a volume flow of $$Q_{comp}(n,p)=Q_{comp}(1500,20)=28.5\ \text{l/min}$$

for a predetermined drive-vector, which comprises a rotational speed of n=1.500 rpm and a pressure of p=20 bar. Another exemplary predetermined drive-vector may comprise a rotational speed of n=1.500 rpm and a pressure of p=280 bar, leading to a computed value for the volume flow of $Q_{comp}$ (1500, 280)=26.55 l/min.

According to the invention, the wear is determined, by means of a second computational method, which basically relates the measured actual volume flow of the hydrostatic pump to the computed volume flow, as computed by using the first computational method. This ratio is the quantitative value of the wear of this pump, at the measuring time.

In an embodiment according to the invention, the second computational method determines a ratio, which is a quotient of the actual volume flow at a predetermined drive-vector to a computed volume flow at the predetermined drive-vector.

Using the above values of the drive-vector as an example, the actual measured volume flow $Q_{act}$ for a predetermined drive-vector, which comprises a rotational speed of 1.500 rpm and a pressure of 280 bar, may be $Q_{act}$ (1500, 280)=24.92 l/min. This would result in following quantitative value for the current wear:

$$w=Q_{act}(1500,280)/Q_{comp}(1500,280)=24.92\ \text{l/min}/26.55\ \text{l/min}=93.86\%$$

In an embodiment according to the invention, the second computational method determines a ratio, which is an average, particularly a weighted average, of a set of quotients, where each of the quotients is the quotient of the actual volume flow at a predetermined drive-vector to a computed volume flow at the predetermined drive-vector.

Using the above values of the drive-vector as an example again, the actual measured volume flow for a predetermined drive-vector, which comprises a rotational speed of 1.500 rpm and a pressure of 20 bar, may be $Q_{act}$ (1500, 20)=27.2 l/min. For p=280 bar: $Q_{act}$ (1500, 280)=24.92 l/min (same value as above). This would result in following quantitative values for the current wear:

$$w(1500,280)=Q_{act}(1500,280)/Q_{comp}(1500,280)=24.92\ \text{l/min}/26.55\ \text{l/min}=93.86\%$$

$$w(1500,20)=Q_{act}(1500,20)/Q_{comp}(1500,20)=27.2\ \text{l/min}/28.5\ \text{l/min}=95.44\%$$

Accordingly, the current average wear would be w=94.65%.

As an alternative, the values of w could be weighted. For instance, values of w at lower pressures could be weighted less and the values at higher pressures could be weighted more. One reason of this higher emphasis of the wear at higher pressures could be that the system is run more often with higher pressures. Taking, as a quantitative example, a weight of 20% for the wear @ 20 bar and 80% for the wear @ 280 bar. Then, using the same values as above, the weighted current average wear would be w=95.12%.

In an embodiment according to the invention, the drive-vector comprises a rotational speed of the drive.

One advantage of considering the rotational speed is that it is immediately clear for an operator, that—for pumps with a variable-speed drive—the performance of the hydraulic system is strongly correlated to the current rotational speed of the drive. Operators of hydraulic systems are used to consider tables based on the rotational speed of the drive for judging the performance of the drive. Furthermore, this value can easily be measured.

In an embodiment, according to the invention, the drive-vector comprises a first pressure of the fluid.

As a general rule, the leakage flow of a pump is higher for higher pressures. Thus, it is advantageous to take a first pressure of the fluid into account when determining the volume flow.

In an embodiment according to the invention, the drive-vector comprises a second pressure of the fluid.

The second pressure may be related to the pressure at the second pressure port of the pump. For instance, the first pressure may be related to a first pressure port of the pump, which achieves a high working pressure for the pump cylinder's movement. The second pressure affects the second port of the pump and produces a low preload pressure. The difference of first and second pressure influences the leakage flow of the pump.

In an embodiment according to the invention, the drive-vector comprises a viscosity of the fluid.

The viscosity of the fluid also influences the volume flow of the fluid. Hence, it is important to consider the viscosity in the drive-vector. Often, the viscosity has a typical value for one type of a hydraulic fluid. This needs to be considered in cases when the fluid is exchanged with another type of hydraulic fluid.

Furthermore, the viscosity of the fluid may depend on its temperature. Different types of fluids usually have different types of dependencies on its temperature.

In an embodiment according to the invention, the drive-vector comprises a temperature of the fluid.

The temperature of the fluid, particularly, influences the fluid's viscosity, depending on the type or class of fluid. Furthermore, it may influence the overall behaviour of the volume flow, because the hydraulic fluid is in most moving parts of the hydraulic system.

For other embodiments of a method according to this invention, further values may be comprised by the drive-vector. Examples could be the type of hydraulic fluid, the maximum performance of the pump system, or the promotional volume of the pump.

In an embodiment according to the invention, the first computational method comprises a linear function or a polynomial function of the values of the drive-vector.

To keep the examples simple and intuitive, in the following only the dependency of one value is discussed. In reality, the volume flow depends on the complete drive-vector of dimension D.

One example to build a computational model of a pump or a class of pumps could be to measure the volume flow of a newly manufactured pump, dependent on the first pressure of the hydraulic fluid. One may select a range from $p_{min}$=25 bar to $p_{max}$=275 bar, measured either at equidistant measuring points, e.g. with a distance of 25 bar, or on a predefined selection of measuring points. Then, a linear curve through these measuring points is constructed, e.g. following the mean squared error (MSE) method. As an alternative, a polynomial function through these measuring points may be constructed.

To gather all the dimensions of the complete drive-vector, the measurements can be done with all values, or on a predefined selection of samples, of the complete drive-vector of dimension D. For some pumps, it may be sufficient to consider only a subset of the dimensions and/or the values of the drive-vector.

For computing the computed volume flow, by means of a first computational method, at the predetermined drive-vector, the linear or the polynomial function of the values of the drive-vector is applied to the predetermined drive-vector.

In an embodiment according to the invention the first computational method comprises an n-dimensional matrix of sampling points.

In this embodiment, only the sampling points of the measurements are stored in the n-dimensional matrix. For computing the computed volume flow at the predetermined drive-vector, first the next neighbours of the predetermined drive-vector in the n-dimensional matrix are determined. Afterwards, an interpolation, e.g. a linear interpolation, is done to determine the computed volume flow at the predetermined drive-vector.

In an embodiment according to the invention the matrix of sampling points is determined by one or several, particularly weighted, measurements.

The measurements, which are stored in an n-dimensional matrix, may be done by measuring several pumps of one class. In a further embodiment, the measurement values may be weighted. This is advantageous, e.g. to cope with statistical outliers.

For further embodiments, the dynamic behaviour of the pump may also be considered. For instance, the dynamic correlation between the rotational speed of the pump and the resulting volume flow for a system with defined fluid passages could be considered.

In an embodiment according to the invention the matrix of sampling points and/or the linear function and/or the polynomial function of the values of the drive-vector is stored locally and/or centrally.

In this embodiment, the parameters or functions that support the first computational method—i.e. sampling points of the measurements and/or the computing functions—are stored in a non-volatile memory, e.g. in a flash-drive or on a magnetic disc, which is part of the electronic control unit (ECU) of this pump. This is particularly advantageous for stand-alone pumps and/or for pumps with no or with restricted communication connection to other devices.

There is also a possibility to store the sampling points of the measurements—only or additionally—centrally, e.g. on a central server or in a computer cloud. This is advantageous, if warnings, evaluations of any kind, and/or maintenance strategies should be derived from the current wear status of the pump. Furthermore, this could be a base to gather the complete life-cycle of each pump, and gives also the opportunity to compare pumps, particularly pumps with a wear-rate above or below average.

In an embodiment according to the invention, the wear is used for a prediction of the wear of the hydrostatic pump.

This particularly makes sense, if both the complete life-cycle of a pump and many data of the wear-rates of a class of pumps are available. Typically, this not only comprises some current values, but it may rather comprise a "wear-history" of one or of many pumps. Based on these data, a prediction of the wear of this hydrostatic pump can be made, e.g. by using a Markov method like Markov-chains.

This invention can by implemented as a hydrostatic pump device, particularly a radial piston pump, having a variable-speed drive and an electronic control unit (ECU), which is capable of performing a method according to one of the preceding claims.

The ECU may comprise one or more processors and memory, particularly some types of memory, e.g. volatile and non-volatile memory components. Some embodiments may comprise means for data connection, e.g. a LAN-cable, a serial connection and/or a wireless connection.

Further objects of the invention will be brought out in the following part of the specification.

Figure 2:
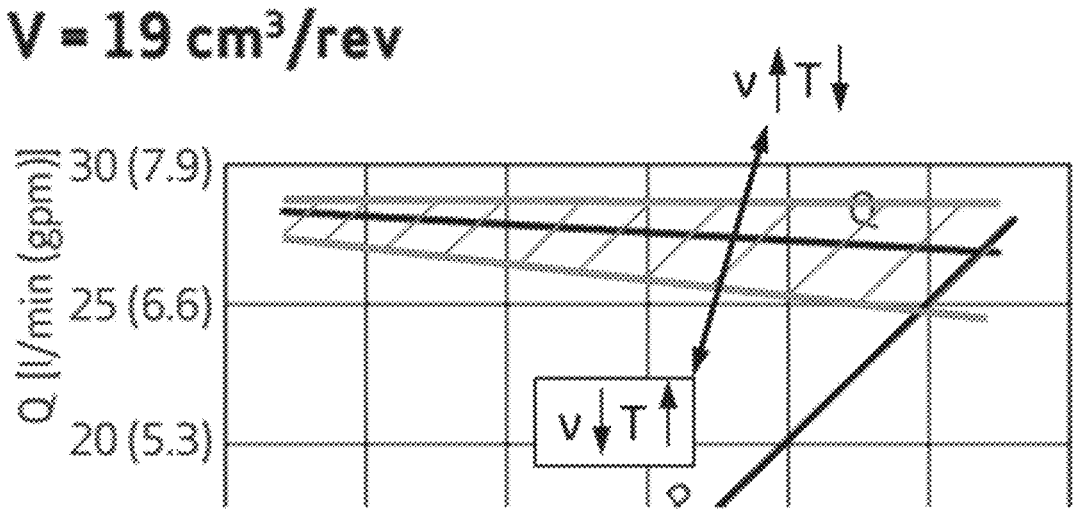
Figure 3:
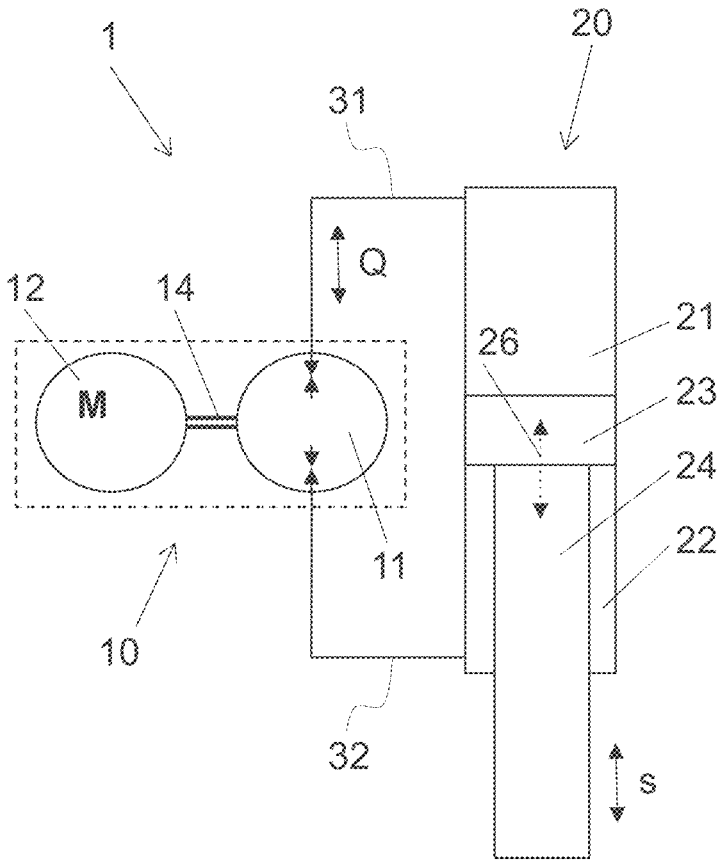
Figure 4:
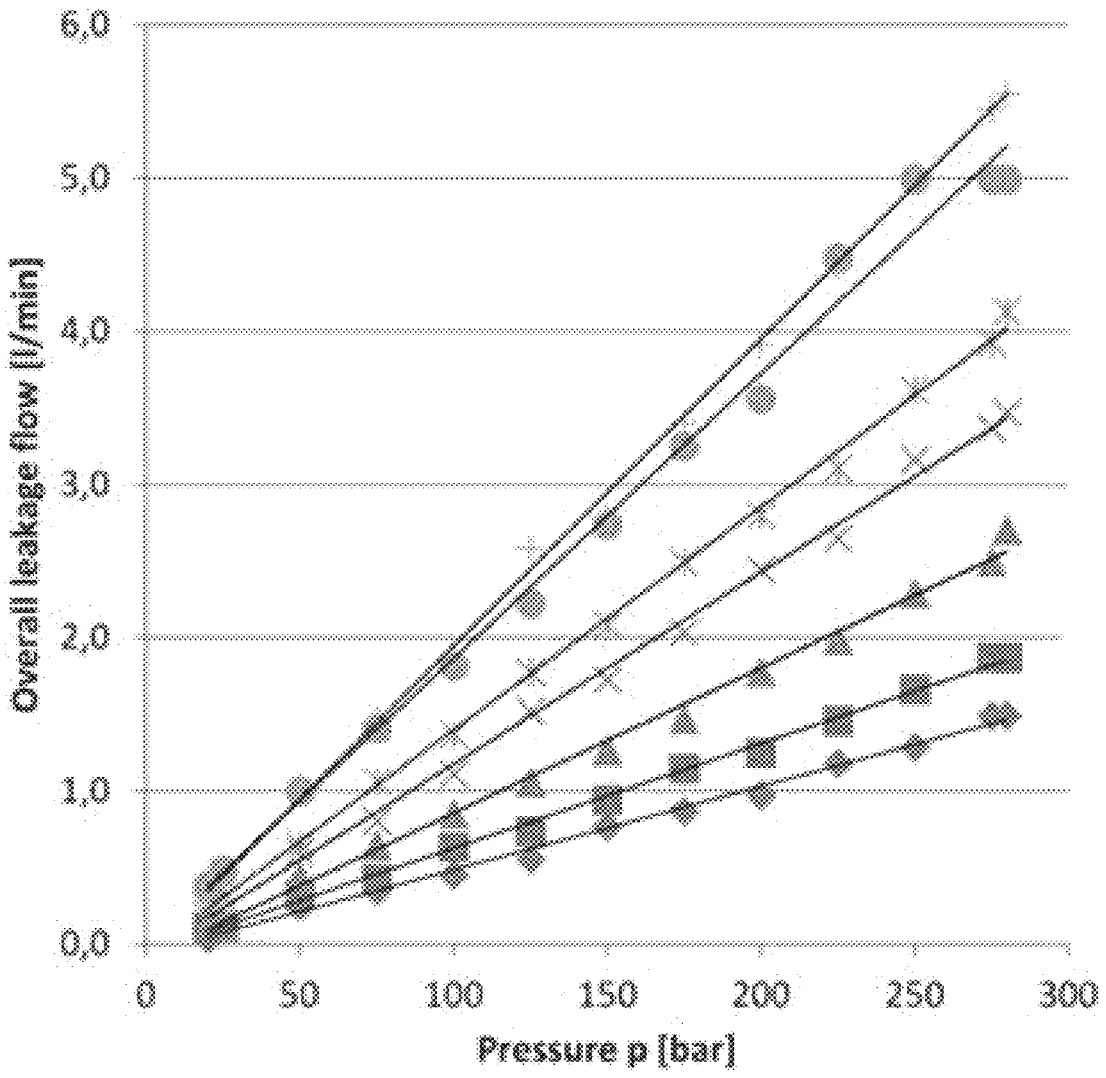

The figures show:

FIG. 1: An example of the performance curves of a radial piston pump;

FIG. 2: An example of variations of volume flows, depending on viscosity and temperature;

FIG. 3: Parts of a simplified hydraulic system comprising a pump and a cylinder;

FIG. 4: An example of variations of volume flows, measured for selected rotational speeds.

FIG. 1 depicts an example of the performance curves of an arbitrary radial piston pump, as typically shown on datasheets of hydraulic pumps. One curve, labelled with "P", shows the relation between power P consumed by the pump's electric motor (right y-axis) and the pressure p provided by the pump. Another curve, labelled with "Q", shows the relation between volume flow Q (left y-axis) and the pressure p. It is clearly visible that the volume flow Q decreases—at least slightly—for higher pressures p. This is mainly caused by a higher leakage flow at higher pressures. The leakage—and thus the steepness of this curve labelled "Q"—may be lower for pumps with high-density seals and/or cylinders. For worn-out pumps, both the values of this curve decrease and the steepness of this curve increases.

FIG. 2 depicts another example of the performance curves of the pump of FIG. 1, but it shows examples of the dependency of the curve "Q" on viscosity and temperature, using an arbitrary example-fluid. In this FIG. 2 it is clearly visible that the values of this (bright grey) curve decrease and the steepness of this curve increases for lower viscosity v and/or higher temperature T of the fluid. Also, the values of this curve increase and the steepness of this curve decreases for higher viscosity v and/or lower temperature T of the fluid.

FIG. 3 depicts some parts of a simplified hydraulic system comprising a pump apparatus 10, a cylinder 20, and fluid passages 31, 32. (Further necessary components of a hydraulic system, which are of lower relevance for this invention, are not shown.) The pump apparatus 10 comprises a pump 11, which is driven by a variable-speed electric motor 10 via shaft 14, which has during operation a rotational speed n. The pump 11 is connected to a differential cylinder 20 via fluid passages 31, 32. The differential cylinder 20 comprises piston 23, piston rod 24, and two chambers 21, 22. The pump 11 pumps the hydraulic fluid via passages 31, 32 to said cylinder 20. The upper passage 31 of the cylinder 20 is connected to a first pressure chamber 21, and the lower passage 32 is connected to a second pressure chamber or annular chamber 22. By pumping the hydraulic fluid into the first 21 or the second 22 pressure chamber, the piston 23 and the piston rod 24 are moved down or up, respectively, as shown by the arrow 26 with dotted line. The piston rod 24 is moved with velocity or speed s. There are several methods to measure the actual volume flow $Q_{act}$: It can be measured by a flow meter in at least one of the passages 31 or 32. Or the velocity s of piston rod 24 can be measured and multiplied with a factor that expresses the piston areas of the first 21 or the second 22 pressure chamber, depending on the direction of the movement.

FIG. 4 depicts an example of variations of volume flows, measured for selected rotational speeds. The diagram shows several sample points of measurements of the volume flows with leakage flows. The measurements are taken for several pressures, i.e. comprising equidistant values of pressures with p=(25, 50, 75, . . . 275) [bar]. The measurements are also taken for several rotational speeds n, e.g. for n=(300, 500, 1000, 1500, . . . ) [rpm]. In this example, a linear curve through these measuring points is constructed, by using the mean squared error (MSE) method.

LIST OF REFERENCE SIGNS

1 electro-hydrostatic drive
10 electric motor
11 pump apparatus
12 electric motor
14 shaft
20 cylinder
21 first pressure chamber
22 second pressure chamber
23 piston
24 piston rod
26 arrow with dotted line
31, 32 passage
n rotational speed
p pressure
Q volume flow
$Q_{act}$ current actual volume flow
$Q_{comp}$ computed volume flow
s speed of piston rod
T fluid temperature
v fluid viscosity
w current wear

The invention claimed is:

1. A method for determining a current wear of a hydrostatic pump, the method comprising:

providing a variable-speed electric motor operable to drive the hydrostatic pump;

providing a fluid passage connected with the hydrostatic pump, wherein a fluid is communicated through the fluid passage by the hydrostatic pump, the hydrostatic pump creating a current actual volume flow in the fluid passage;

determining the current actual volume flow (Qact) by measuring the volume flow in the fluid passage at a predetermined drive-vector, wherein the pre-determined drive-vector includes a first pressure and a second pressure of the fluid;

determining a computed volume flow (Qcomp) by a first computational method, at the predetermined drive-vector; and determining the current wear of the hydrostatic pump by a second computational method, which relates the current actual volume flow (Qact) to the computed volume flow (Qcomp), wherein the first pressure is a working pressure of the fluid, and the second pressure is a preload pressure of the fluid.

2. The method of claim 1, wherein the second computational method determines a ratio, which is a quotient of the actual volume flow (Qact) at the predetermined drive-vector to the computed volume flow (Qcomp) at the predetermined drive-vector.

3. The method of claim 1, wherein the second computational method determines a ratio, which is an average of a set of quotients, wherein each of the quotients is the quotient of the actual volume flow (Qact) at the predetermined drive-vector to the computed volume flow (Qcomp) at the predetermined drive-vector.

4. The method of claim 3, wherein the average of the set of quotients is a weighted average.

5. The method of claim 1, wherein the drive-vector comprises: a rotational speed of the variable-speed drive.

6. The method of claim 1, wherein the drive-vector comprises: a viscosity of the fluid.

7. The method of claim 1, wherein the drive-vector comprises: a temperature of the fluid.

8. The method of claim 1, wherein the first computational method comprises a linear function or a polynomial function of values of the drive-vector.

9. The method of claim 1, wherein the first computational method comprises an n-dimensional matrix of sampling points.

10. The method of claim 9, wherein the matrix of sampling points is determined by several measurements.

11. The method of claim 10, wherein the several measurements are weighted.

12. The method of claim 9, wherein the matrix of sampling points is stored locally and/or centrally.

13. The method of claim 1, wherein determining the wear is used for a prediction of the wear of the hydrostatic pump.

14. The method of claim 1, wherein the hydrostatic pump is a radial piston pump.

15. The method of claim 1, further comprising providing a cylinder in fluid connection with the hydrostatic pump, wherein the working pressure of the fluid is operable to move the cylinder.

16. An electro-hydrostatic pump device, comprising:

a radial piston pump;

a variable-speed motor operable to drive the radial piston pump; and an electronic control unit;

wherein the radial piston pump is connected to a fluid passage in which a fluid is communicated by the radial piston pump, the radial piston pump operable to create a current actual volume flow in the fluid passage, wherein the electronic control unit is operable to measure the volume flow in the fluid passage at a predetermined drive-vector including a first pressure and a second pressure of the fluid, respectively, to determine the current actual volume flow (Qact);

wherein the electronic control unit is operable to determine a computed volume flow (Qcomp) by a first computational method, at the predetermined drive-vector including the first pressure and the second pressure of the fluid, respectively; and wherein the electronic control unit is operable to determine the current wear (w) of the pump by a second computational method, which relates the current actual volume flow (Qact) to the computed volume flow (Qcomp), wherein the first pressure is a working pressure of the fluid, and the second pressure is a preload pressure of the fluid.

* * * * *